US006595509B2

(12) United States Patent
Sesek

(10) Patent No.: US 6,595,509 B2
(45) Date of Patent: Jul. 22, 2003

(54) STAPLER HAVING SELECTABLE STAPLE SIZE

(75) Inventor: Robert Sesek, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/340,905

(22) Filed: Jan. 11, 2003

(65) Prior Publication Data

US 2003/0102618 A1 Jun. 5, 2003

Related U.S. Application Data

(62) Division of application No. 09/924,203, filed on Aug. 7, 2001, now Pat. No. 6,550,757.

(51) Int. Cl.[7] ..... B65H 37/04

(52) U.S. Cl. ..... 270/58.09; 270/58.08; 399/410; 227/2; 227/5

(58) Field of Search ..... 270/58.09, 58.08; 399/410; 227/2, 5

(56) References Cited

U.S. PATENT DOCUMENTS 5,187,534 A * 2/1993 Iwata et al. ..... 399/410

FOREIGN PATENT DOCUMENTS

JP 2-233462 A * 9/1990
JP 4-89294 A * 3/1992
JP 5-83460 A * 4/1993
JP 11-301919 A * 11/1999

* cited by examiner

*Primary Examiner*—Patrick Mackey

(57) ABSTRACT

A stapler for driving a staple into a sheet stack. The stapler includes a first cartridge configured to receive a first staple defined by a first leg length, and a second cartridge configured to receive a second staple defined by a second leg length. The stapler includes a stapling head configured to drive the staples into the sheet stack, and a cartridge positioning actuator configured to selectively position either the first or the second cartridge over a predetermined position on the sheet stack. The stapler can have a single stationary stapling head, and the cartridges can be moved in position over the stapling head. Alternately, each cartridge can have its own associated stapling head. The stapler can include a sensor to determine the thickness of the sheet stack. A controller can receive a thickness signal from the sensor and determine which of the cartridges to position over the sheet stack.

4 Claims, 8 Drawing Sheets

STAPLER HAVING SELECTABLE STAPLE SIZE

CROSS REFERENCE TO RELATED APPLICATIONS

This application is a Divisional Patent Application of U.S. patent application Ser. No. 09/924,203, now U.S. Pat. No. 6,550,757 filed Aug. 7, 2001.

FIELD OF THE INVENTION

The invention claimed and disclosed herein pertains to staplers, and in particular to automatic staplers for stapling a stack of sheets together.

BACKGROUND OF THE INVENTION

Automatic staplers are well known in the art. Such staplers can either be stand-alone units, or they can be integrated into another device. These integrated staplers and other finishing devices are often referred to as "in-line" devices. For example, many imaging apparatus, such as photocopiers and printers, can be configured with an automatic stapler for the stapling together of sheets of finished product. Frequently a stapler in a photocopier or a printer is part of a sorter-stacker attachment which can be used to sort, stack and collate sheets of finished product. Examples of such attachment devices incorporating staplers are described in U.S. Pat. Nos. 5,542,655 and 5,269,503, incorporated herein by reference. In the typical stapling process, a wire staple is driven into the top of a sheet stack by a stapling head. An anvil adjacent the back side of the sheet stack crimps the staple to thereby secure the sheets in the stack into a bound unit. The staples are typically provided in the form of a strip of pre-formed staple blanks which are attached to one another by glue or resin.

A common problem encountered by most stapling devices is that of using a staple of the proper size to staple together the sheet stack. A staple is defined by two essentially parallel legs which are joined in spaced-apart relationship by a crown portion. The legs of the staple should be at least as long as the thickness of the sheet stack to be stapled, otherwise the staple fails of its essential purpose, i.e., of holding all sheets in the stack together. Further, the legs of the staple should be of such a length that after the staple is driven into the sheet stack, the free ends protrude a sufficient distance beyond the last sheet to allow the free ends to be crimped around the back side of the sheet stack. Preferably, the free ends are crimped using a forming anvil so that the free ends are directed back towards the last sheet in the sheet stack. This not only helps to secure all of the sheets in the stack together, but also hides the sharp free ends of the staple which can cause injury and damage if they are left protruding beyond the bottom sheet in the stack. However, if the legs of the staple are much longer than the thickness of the sheet stack, then when the crimp is formed the free ends can actually be driven back through the sheet stack to thus protrude through the first sheet in the stack, presenting a hazard to persons handling the stapled sheet stack. This phenomenon can also damage the stapling head or cause it to jam. An oversized staple can also cause damage to the sheets in the sheet stack.

To address this problem of using a staple of the proper length, some staplers can accept different sized staples in the stapler, but only one size of staple is available for use by the stapler at any given time. This process requires a user to remove any staples which may be in the stapler and insert staples of the perceived correct size. It also requires that the user somehow be aware of the size of staples currently in the stapler. For stand-alone staplers this process is a relatively minor inconvenience, but for automatic in-line staplers used in imaging apparatus the process becomes more involved, and may even require the process to be performed by a trained technician.

Another solution to the problem is addressed by the use of a staple-forming device which forms a staple of the desired length from a reel of wire contained within the stapling apparatus. Such stapling apparatus are usually found in imaging apparatus, such as photocopiers. Examples of such stapling apparatus are described in U.S. Pat. Nos. 4,318,555 and 5,938,388. The apparatus described in the '555 patent is configured to form staples of two different lengths from two separate spools of wire. The apparatus described in the '388 patent forms a staple of a determined length from wire, using a sensor which detects the thickness of the sheet pack to determine the length of the staple. While these stapling apparatus may address the problem of using a staple of the proper length, the apparatus are quite complex.

What is needed then is a stapler which achieves the benefits to be derived from similar prior art devices, but which avoids the shortcomings and detriments individually associated therewith.

SUMMARY OF THE INVENTION

The present invention provides for a stapling apparatus which can contain at least two different sizes of staples (i.e., staples having different leg lengths) and can make any of the (two or more) staples available for use at any given time without requiring a user to remove and install staples. The staple most appropriate for stapling a given sheet stack can be selected from among the different sized staples which are provided in the stapler. The staples can either be provided in a strip of pre-formed staples, or they can be formed from a flat stack of pre-cut lengths of wire stock. The stapler can be provided with a sensor or other means to determine or estimate the thickness of the sheet stack. The stapler can also be provided with a controller which can use information from the sensor or other means to determine which staple available in the stapler should be used, based on the thickness of the sheet stack and the leg length of the staple. The stapler can be a stand-alone unit, or it can be part of an imaging apparatus (such as a photocopier or a printer). When the stapler is part of a copier or a printer (generically, "imaging device"), then the imaging device can be provided with a processor that can determine the number of pages in each sheet stack of a print job, and can also determine the media thickness of each sheet in the sheet stack. The processor can then determine the estimated thickness of the sheet stack, and this information can be used to select the staple most appropriate for stapling the sheet stack.

One embodiment of the present invention provides for a stapler for driving a staple into a sheet stack defined by a plurality of sheets. The stapler comprises a first cartridge configured to receive a first staple defined by a first leg length, and a second cartridge configured to receive a second staple defined by a second leg length. Preferably, the staples are provided to the cartridges in the form of strips of staples which are removably attached to one another. The stapler has a stapling head configured to drive the staples into the sheet stack. The stapler further includes a cartridge positioning actuator configured to selectively position either the first cartridge or the second cartridge in line with the stapling head. In one configuration the cartridge positioning actuator comprises a first solenoid having an extensible arm in mechanical communication with the first cartridge. The cartridge positioning actuator can further include a second solenoid having an extensible arm in mechanical communication with the second cartridge. In another configuration the cartridge positioning actuator comprises a linear motor having a body and a slide portion configured to slidably move with respect to the body, and the first cartridge is supported by the slide portion. The second cartridge can also be supported by the slide portion of the linear motor. It should be appreciated that the stapler can include more than two cartridges to thereby provide to a user of the stapler a wider selection of staples.

The stapler can further include a controller configured to actuate the cartridge positioning actuator in response to receiving an input signal. A sensor or other means configured to detect or estimate the thickness of the sheet stack can be provided. The sensor can generate a thickness signal in response to detecting the thickness of the sheet stack, and the controller can use the thickness signal as the input signal for actuating the cartridge positioning actuator. In this way the controller, in conjunction with the sensor, can determine which staple is the correct staple to use based on the thickness of the sheet stack, and the controller can then cause the appropriate staple cartridge to be moved into position for stapling (assuming the appropriate cartridge was not already in position).

The stapler can also be placed within an imaging apparatus which is configured to generate the sheet stack. The imaging apparatus can include a sheet counting device configured to count the number of sheets in the sheet stack and to generate a sheet count signal in response thereto. In this case, as an alternative to (or in addition to) using a sensor to measure the thickness of the sheet stack, the controller can use the sheet count signal as the input signal for actuating the cartridge positioning actuator. The sheet counting device can be a device configured to detect the number of sheets of media which are deposited into an output tray as the sheet stack is formed. The sheet counting device can also receive information from a user console associated with the imaging device, as for example when a user enters via a keypad the desired number of copies of an original to be generated by the imaging apparatus. The sheet count signal (i.e., the total number of sheets in a sheet stack) can be used to estimate the sheet stack height by multiplying the sheet count signal by an average media thickness. Alternatively, the sheet stack signal can be supplemented with media type information so that the height of the sheet stack can be more accurately determined. The media type information can be obtained from sensors which can detect the thickness or weight (and therefore the approximate thickness) of the media. The media type information can also be provided by a user via the user console.

Accordingly, the controller is generally configured to determine an approximate thickness of the sheet stack using the input signal (such as from a thickness measuring sensor) to determine which of the first and second cartridges contains a staple having a leg length most suited for stapling the sheet stack. The controller can then actuate the cartridge positioning actuator if the determined cartridge is not currently positioned in-line with the stapling head. Thereafter the controller can generate a "staple" signal to actuate a stapling head actuator. The stapling head actuator is configured to cause the stapling head to drive the staple into the sheet stack in response to receiving the "staple" signal.

Another embodiment of the present invention provides for a stapling apparatus for driving a staple into a sheet stack defined by a plurality of sheets. The stapling apparatus comprises a first stapler and a second stapler. The staplers each comprise respective first and second cartridges configured to receive respective first and second staples. The staples are defined by respective first and second leg lengths. The staplers further include respective first and second stapling heads configured to drive the respective first and second staples into the sheet stack. The stapling apparatus has a stapler positioning actuator configured to selectively position one of the first or the second stapler heads over a predetermined position on the sheet stack. The primary difference between the stapling apparatus just described and the stapler previously described is that in the latter stapling apparatus the stapling heads move along with the staple cartridges, whereas in the former stapler the staple cartridges move with respect to the stapling head. It should be understood that when I talk about positioning the selected staples over a "predetermined position" on the sheet stack I mean a position where the stapled is intended to be placed. This position can vary, such as when an in-line stapler is moved to staple the top or side of the sheet stack.

The stapler positioning apparatus in the stapling apparatus can comprises one of a solenoid or a linear motor, in a manner similar to that described above with respect to the stapler. Likewise, the stapling apparatus can include a controller, as well as associated components (such as a sheet stack thickness sensor), which can all function in a manner similar to that previously described. In this way the staplers can be automatically positioned over the sheet stack to thus present the appropriate staple for stapling the sheet stack.

As stated previously, a stapler in accordance with the present invention can be a stand-alone unit, or it can be incorporated into another apparatus, such as an imaging apparatus. Accordingly, a third embodiment of the present invention provides for an imaging apparatus configured to generate a stack of sheets of media bearing images and to deposit the stack of sheets of media in an output tray. The imaging apparatus comprises a stapler, which itself comprises a first cartridge configured to receive a first staple defined by a first leg length, and a second cartridge configured to receive a second staple defined by a second leg length. The stapler further includes a stapling head configured to drive the staples into the sheet stack, and a cartridge positioning actuator configured to selectively position one or the other of the first or the second cartridges over a predetermined position on the sheet stack. The stapler also has a stapling head configured to drive staples from the cartridge positioned over the predetermined position on the sheet stack into the sheet stack.

As with the stapler and the stapling apparatus previously described, the imaging apparatus can include a controller and associated components (such as a sheet stack thickness sensor) which can all function in a manner similar to that previously described. In this way the cartridges can be automatically positioned over the predetermined position on the sheet stack to thus present the appropriate staple for stapling the sheet stack.

A fourth embodiment of the present invention includes a method of stapling together a first stack of sheets of media. The method includes the step of providing a first strip of staples having legs defined by a first length, and providing a second strip of staples having legs defined by a second length. One of the first or the second strips of staples are then moved over a predetermined position on the first stack of sheets. The method includes detaching a staple from the strip of staples moved over the predetermined position on the stack of sheets and driving the staple through the stack of sheets. The method can also include measuring the thickness of the stack of sheets, and then selecting the strip of staples to be moved over the predetermined position on the, stack of sheets based on the measured thickness. Alternately, rather than measuring the thickness of the stack of sheets, the method can include estimating the thickness of the stack of sheets, and then selecting the strip of staples to be moved over the predetermined position on the stack of sheets based on the estimated thickness.

Since the stapler can be provided in an imaging apparatus, as previously described, and since the imaging apparatus can,be provided with a sorter to sort multiple copies of a document into separate sheet stacks, the method can thus include the step of moving the strips of staples to a location near a second stack of sheets. A staple from the strip of staples moved over the predetermined position on the second stack of sheets is then detached from the strip and is driven through the second stack of sheets.

These and other aspects and embodiments of the present invention will now be described in detail with reference to the accompanying drawings, wherein:

DETAILED DESCRIPTION OF THE INVENTION

The present invention provides for a stapler or a stapling apparatus which contains two or more sizes of staples. The staple most appropriate for stapling a given stack of sheets of media (i.e., the staple having a leg length which is of sufficient length, but not overly long) can thus be selected from the available staples in the stapler, and the selected staple driven through the sheet stack to thereby bind the sheets together. Preferably, the staples are provided in strips of pre-formed staples to simplify loading the staples into the stapler. Strips of staples are well known in the art. The staple most appropriate for a given stapling job can thus be selected by moving the strip of staples into a position to allow a staple from the strip to be driven into the sheet stack at a predetermined position. The strips of staples can be manually moved into the stapling position by a user of the stapler. However, the stapler preferably includes a controller which can be used to automatically select the staples and cause the selected staples to be moved into position for stapling the sheet stack. Alternately, the staple most appropriate for a given stapling job can be selected by moving the sheet stack into a position under the strip of staples to allow a staple from the strip to be driven into the sheet stack at a predetermined position. The sheet stack can be positioned either manually or automatically. By a "predetermined position" on the sheet stack I mean a selected position on the sheet stack where the stapled is intended to be placed. This position can vary, such as when an in-line stapler is moved to staple the top or side of the sheet stack. A more detailed description of the present invention will be provided below.

The present invention pertains to staplers, or stapling apparatus, which are used to staple together a stack of sheets of media. For example, the most common media to be stapled together are sheets of paper. I will use the expression "sheet stack" or "stack" to mean a stack of a plurality of sheets of media which can be stapled together. However, the invention should not be considered as limited to apparatus for stapling together only sheets of paper. Further, a stapling apparatus in accordance with the present invention can be a stand-alone stapler, or it can be a stapler which is incorporated into another apparatus. Specifically, a stapler in accordance with the present invention can be included in an imaging apparatus (such as a photocopier or a printer) to staple sheet stacks which are produced by the imaging apparatus. In this arrangement the stapler can be provided as part of a sorting/collating attachment for an imaging apparatus.

Figure 1:
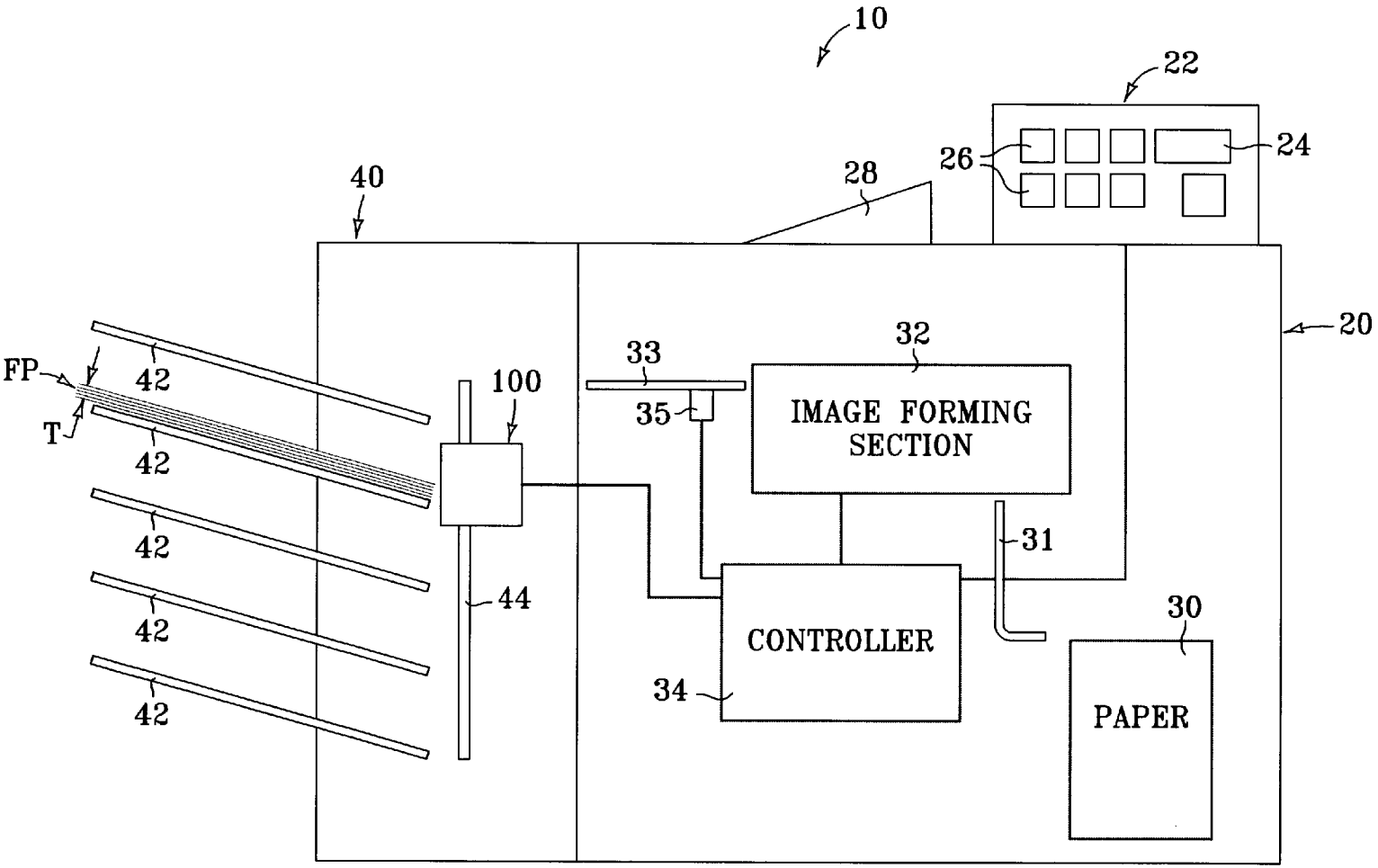
FIG. 1 is a front elevation view depicting an imaging apparatus using a stapler in accordance with a first embodiment of the present invention.

Turning now to FIG. 1, a schematic diagram depicts a simplified side view of an imaging apparatus 10, which can be a photocopier, a printer, or a combination copying/printing apparatus. The imaging apparatus 10 generally depicts an environment in which a stapler 100 of the present invention can be found. The imaging apparatus 10 includes a main body 20, and a sorter attachment 40. The main body 20 can house a supply sheets of one or more types of media, such as paper 30, upon which images can be formed. The sheets of media 30 can be moved via a paper path 31 to an image forming section 32, where an image can be formed on the sheets of media. The image forming section 32, which is not germane to the present invention, can be any known type of image forming section, such as an electrophotographic imaging section. The sheets of media 30 are thereafter moved via paper path 33 to the sorter attachment 40. The main body 20 of the imaging apparatus 10 can further include an input tray 28 in which an original document can be placed for photocopying by the imaging section 32. The imaging apparatus 10 can also include a user input station 22 which can include buttons or switches 26 allowing a user to select parameters for the copying or printing process, and a display device 24 which allows the imaging apparatus to provide information to the user. Preferably, the imaging apparatus 10 includes a controller 34 which can receive instructions from the user input station 22, and can control the operation of the image forming section 32, as well as the operation of the stapler 100. The imaging apparatus 10 can also include a sheet counting device 35, the function of which will be described below.

The sorting attachment 40 of the image forming apparatus 10 can include a plurality of output trays 42, thereby allowing multiple copies of a document to be imaged and separated for post imaging processing (such as stapling). The sorter 40 is depicted as holding a single sheet stack of a finished product "FP", which is defined by a thickness "T". The sorter 40 can also include the stapler 100 of the present invention. The stapler 100 can be configured to move vertically in the sorter 40 via the drive mechanism 44, to thereby allow the stapler to access sheet stacks in each of the output trays 42.

Figure 2:
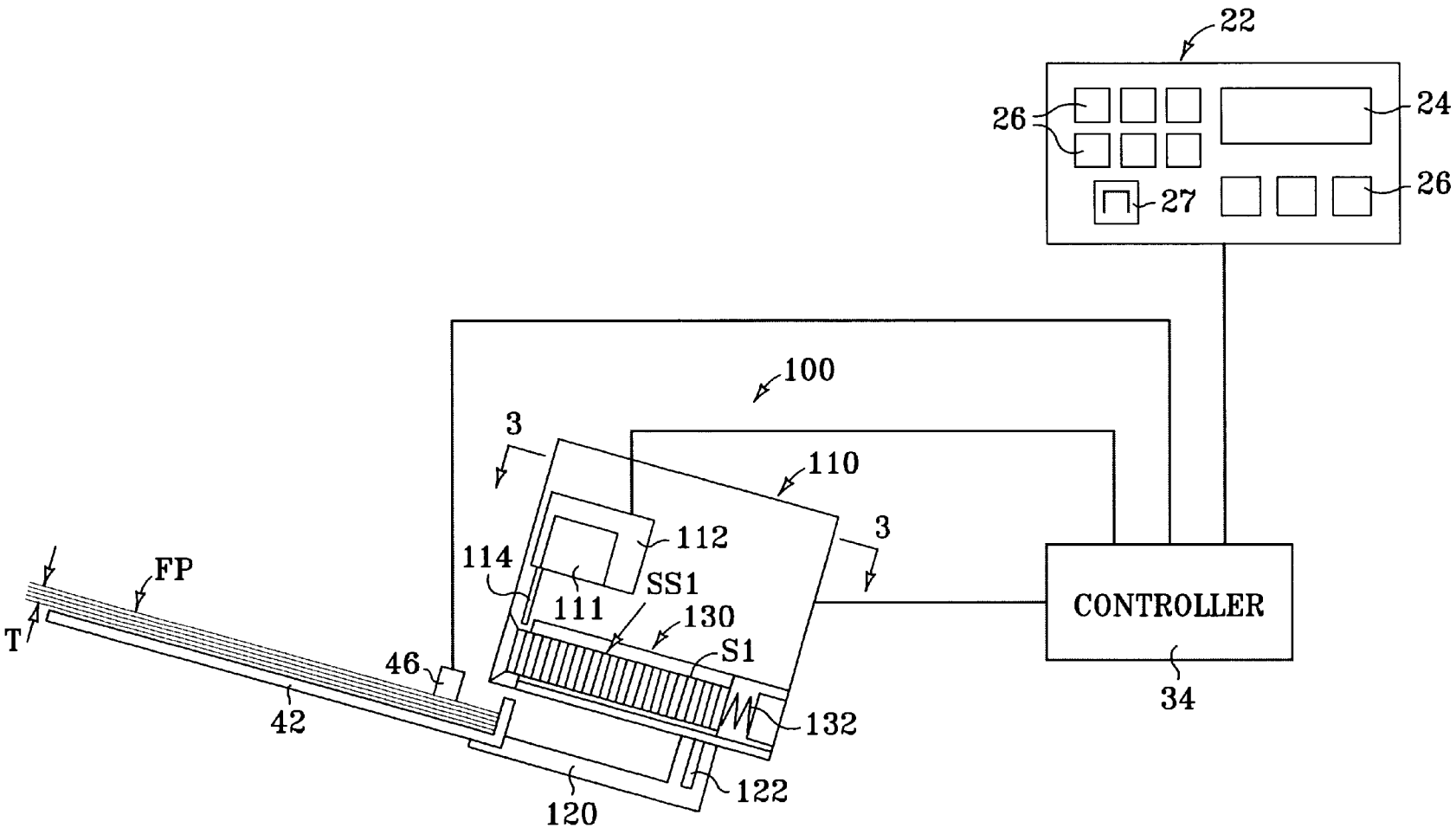
FIG. 2 is a side elevation sectional detail of the stapler depicted in FIG. 1

Turning now to FIG. 2, a side elevation sectional view depicts the stapler 100 of FIG. 1. The controller 34 of FIG.

1 is also depicted, as is the user input station 22. The user input station is depicted as having a "staple" switch 27 which can be used to cause the controller 34 to actuate the stapler 100. The stapler 100 is shown positioned proximate the sheet stack "FP" in the output tray 42. The stapler 100 has an upper body portion 110, and a lower anvil member 120. The upper body portion 110 can be adjustable with respect to the anvil member 120 by the adjustment arm 122. The upper body portion 110 of the stapler 100 has a first staple cartridge 130 which contains a first strip SS1 of staples S1. Staples S1 are defined by a first leg length. The strip of staples SS1 is urged towards the front of the upper body portion 110 by a spring 132. The upper body portion 110 of the stapler 100 also includes a first stapling head 112 which includes a stapling head actuator 111, such as a solenoid. The stapling head actuator 111 can be actuated to cause the striking member 114 to move towards the sheet stack FP, separating a single staple from the staple strip SS1 and driving the staple through the sheet stack. The anvil 120 acts to crimp the ends of the legs of the staple back towards the sheet stack FP as the staple legs penetrate the bottom sheet in the stack. The stapler 100 further includes a second cartridge, which is not visible in the view depicted in FIG. 2, but which can be seen in FIGS. 3 and 4 as cartridge 140.

A sensor 46 is provided proximate the sheet stack FP. The sensor 46 is configured to detect the thickness "T" of the sheet stack FP and to generate a thickness signal in response thereto. The controller 34 can use the thickness signal as an input signal to determine which of the staple cartridges should be selected as the source of staples for the stapling job, as will be described more fully below.

Figure 3:
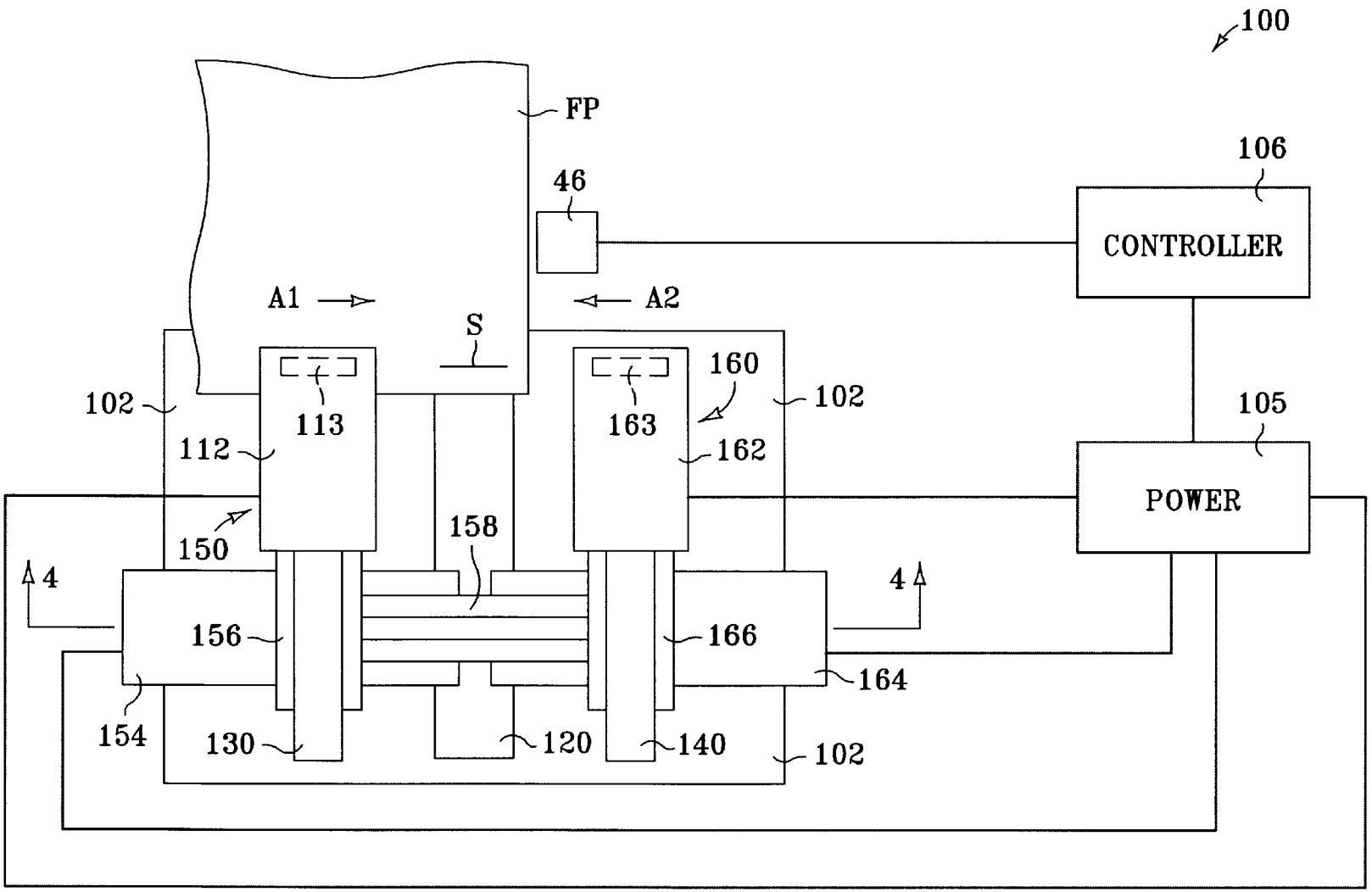
FIG. 3 is a top view of the stapler depicted in FIG. 2.
Figure 4:
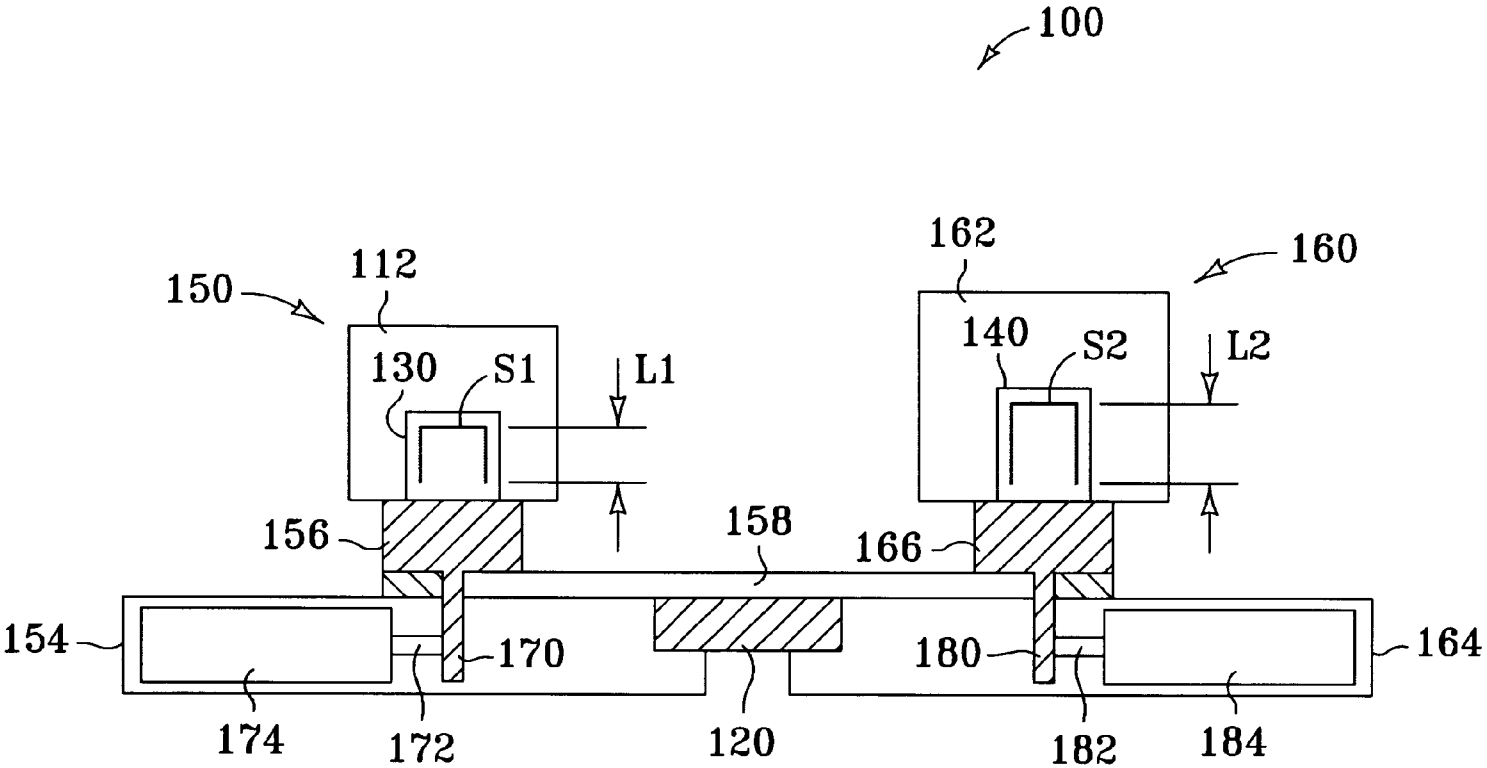
FIG. 4 is an end sectional view of the stapler depicted in FIGS. 2 and 3.

Turning now to FIG. 3, a plan view of the stapling apparatus 100 of FIG. 2 is depicted. An end view of the stapling apparatus 100 is depicted in FIG. 4. FIGS. 3 and 4 will be discussed in conjunction with one another to facilitate understanding of the stapling apparatus 100. In Figs . 3 and 4 the stapling apparatus 100 is not shown with reference to the imaging apparatus 10 of FIG. 1. It is thus understood that the stapling apparatus 100 can operate as a stand-alone unit, separate from any other device, or it can operate as a stapling unit in a device, such as the imaging apparatus 10 of FIG. 1. The stapling apparatus 100 of FIGS. 3 and 4 essentially comprises two separate staplers, a first stapler 150, and a second stapler 160. The first stapler 150 comprises a first cartridge 130 configured to receive a first staple S1 of a first type or size, and which is characterized by a first leg length L1. Preferably, the staples are provided in the form of a strip of staples, such as staple strip SS1 of FIG. 2. The first stapler 150 also includes a first stapling head 112 configured to drive the first staples S1 into the sheet stack FP. The stapling head 112 can include a staple guide 113 to help guide a staple into the sheet stack FP. The first cartridge 130 and the first stapling head 112 are supported by a first support member 156 which is in turn supported by track 158, allowing the first stapler 150 to move in the direction of arrow "A1" from it's position shown to one or more predetermined positions over the sheet stack FP, indicated by the stapling position "S". When multi-position stapling is provided, then the first stapler 150 can also be configured to move in a direction opposite to the direction of arrow "A1". The first stapler 150 is also provided with a first stapler positioning actuator 154 configured to position the first stapling head 112 (and concomitantly, the staple cartridge 130) over the predetermined position "S" on the sheet stack FP.

In like manner, the second stapler 160 comprises a second cartridge 140 configured to receive a second staple S2 of a second type or size, and which is characterized by a second leg length L2. The second stapler 160 also includes a second stapling head 162 configured to drive the second staples S2 into the sheet stack FP. The stapling head 162 can include a staple guide 163 to help guide the, staple into the sheet stack FP. The second cartridge 140 and the second stapling head 162 are supported by a second support member 166 which is in turn supported by track 158, allowing the second stapler to move in the direction of arrow "A2" from it's position shown to a predetermine position over the sheet stack FP, indicated by the stapling position "S". When multi-position stapling is provided, then the second stapler 160 can also be configured to move in a direction opposite to the direction of arrow "A2". The second stapler 160 is also provided with a second stapler positioning actuator 164 configured to position the second stapler head 162 (and concomitantly, the second cartridge 140) over the predetermined position "S" on the sheet stack FP. The actuators 154 and 164 are supported by a frame member 102, which also supports an anvil 120, similar to the anvil 120 of FIG. 2.

With reference to FIG. 4 in particular, it can be seen that the support members 156 and 166 are provided with respective posts 170 and 180 which protrude through a slot in the track 158. The first stapler positioning actuator 154 includes a solenoid 174 which moves an extensible arm 172 which is in mechanical communication with the first cartridge 130 (and the first stapling head 112) via the post 170 and the support member 156. Thus, when the solenoid 174 is actuated, the first stapler 150 (as viewed in FIG. 3) will move to the right in the direction of arrow "A1" to thus position the first stapling head 112 over the stapling position "S". Likewise, the second stapler positioning actuator 164 includes a solenoid 184 which moves an extensible arm 182 which is in mechanical communication with the second cartridge 140 (and the second stapling head 162) via the post 180 and the support member 166. Thus, when the solenoid 184 is actuated, the second stapler 160 (as viewed in FIG. 3) will move to the left in the direction of arrow "A2" to thus position the second stapling head 162 over the stapling position "S".

The stapling apparatus 100 can be provided with a power supply 105 which can be used to power the stapling heads 112 and 162 to thus drive a staple into the sheet stack FP. The power supply 105 can also be used to drive the stapler positioning actuators 154 and 164. A controller 106 can be provided which can function in a manner similar to that described above with respect to controller 34 of FIGS. 1 and 2. A sensor 46 can be located adjacent the sheet pack FP and used to generate a thickness signal, in the manner described above with respect to FIG. 2. The controller 106 can receive the thickness signal and use the signal to determine which-of the two staples in the staple cartridges 130 and 140 is most appropriate for the stapling of the sheet stack FP. The controller 106 can then direct the power supply 105 to actuate either positioning actuator 154 or actuator 164 to thereby position the cartridge (130 or 140) containing the selected staple over the position "S" on the sheet stack FP. The controller 106 can then direct the power supply 105 to actuate the stapling head actuator (located in the stapling head positioned over the sheet stack FP at position "S") to thereby drive a staple from the associated cartridge (130 or 140) through the sheet stack. The anvil 120 causes the free ends of the staple legs to be crimped back towards the last sheet in the sheet stack FP as the free ends are driven through the last sheet in the stack.

Figure 8:
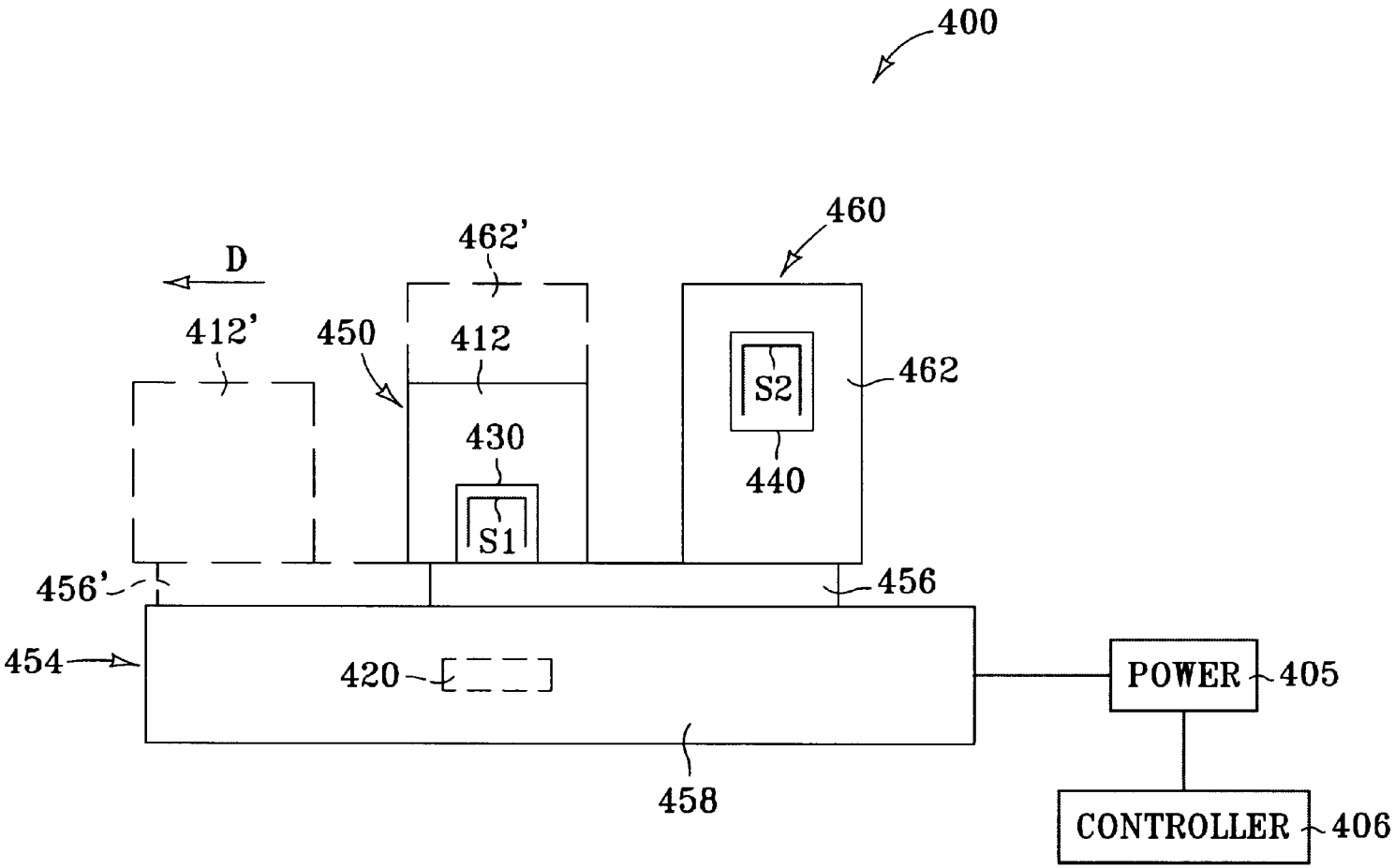
FIG. 8 depicts a simplified end view of a stapler in accordance with a variation on the stapler depicted in FIGS. 3 and 4.

Turning to FIG. 8, a variation on the stapling apparatus 100 depicted in FIGS. 3 and 4 is shown in a simplified end view. The stapling apparatus 400 of FIG. 8 is similar to the stapling apparatus 100 of FIG. 4 in that it comprises a first stapler 450 and a second stapler 460. The first stapler 450 comprises a first cartridge 430 configured to contain a first staple S1 of a first type or size, and a first stapling head 412. The first cartridge 430 and the first stapling head 412 operate in a manner similar to the cartridge 130 and the stapling head 112 of FIG. 3. The second stapler 460 comprises a second cartridge 440 configured to contain a second staple S2 of a second type or size, and a second stapling head 462. The second cartridge 440 and the second stapling head 462 operate in a manner similar to the cartridge 140 and the stapling head 162 of FIG. 3. However, whereas the stapling apparatus 100 of FIG. 3 provides a separate stapler positioning actuator (154, 164) for each stapler (150, 160), the stapling apparatus 400 of FIG. 8 includes a single stapler positioning actuator 454. The stapler positioning actuator 454 as depicted is a linear motor having a motor body 458 and a slide portion 456 configured to slidably move with respect to the body 458. Both the first and the second staplers 450 and 460 are supported by the slide portion 456 of the linear motor 454. Thus, by applying power from power supply 405 to the linear motor body 458, the slide portion 456 can be caused to translationally move both staplers 450 and 460 from a first position to a second position. By reversing the polarity of the power supplied to the linear motor body 458, the slide portion 456 can be caused to translationally move both staplers 450 and 460 from the second position back to the first position.

For example, first stapler 450 (and consequently the second stapler 460) can be positioned as shown by solid lines in the figure such that the first staple S1 of a first type or size is positioned over the anvil 420. In this position staple type S1 will be the staple driven into the sheet stack (not shown). If it is determined that staple size or type S2 is the more appropriate staple to be used to staple the sheet stack (which can be determined using the methods and apparatus described above with respect to stapler 100), then the controller 406 can cause the power supply 405 to apply electrical current to the liner motor body 454, causing the slide portion 456 (and consequently the staplers 450 and 460) to move to the left, to the positions 456', 412' and 462' and indicated by dashed lines. The staple type S2 will now be positioned over the anvil 420 and will be the staple driven into the sheet stack when the stapling head 462 is actuated.

Figure 6:
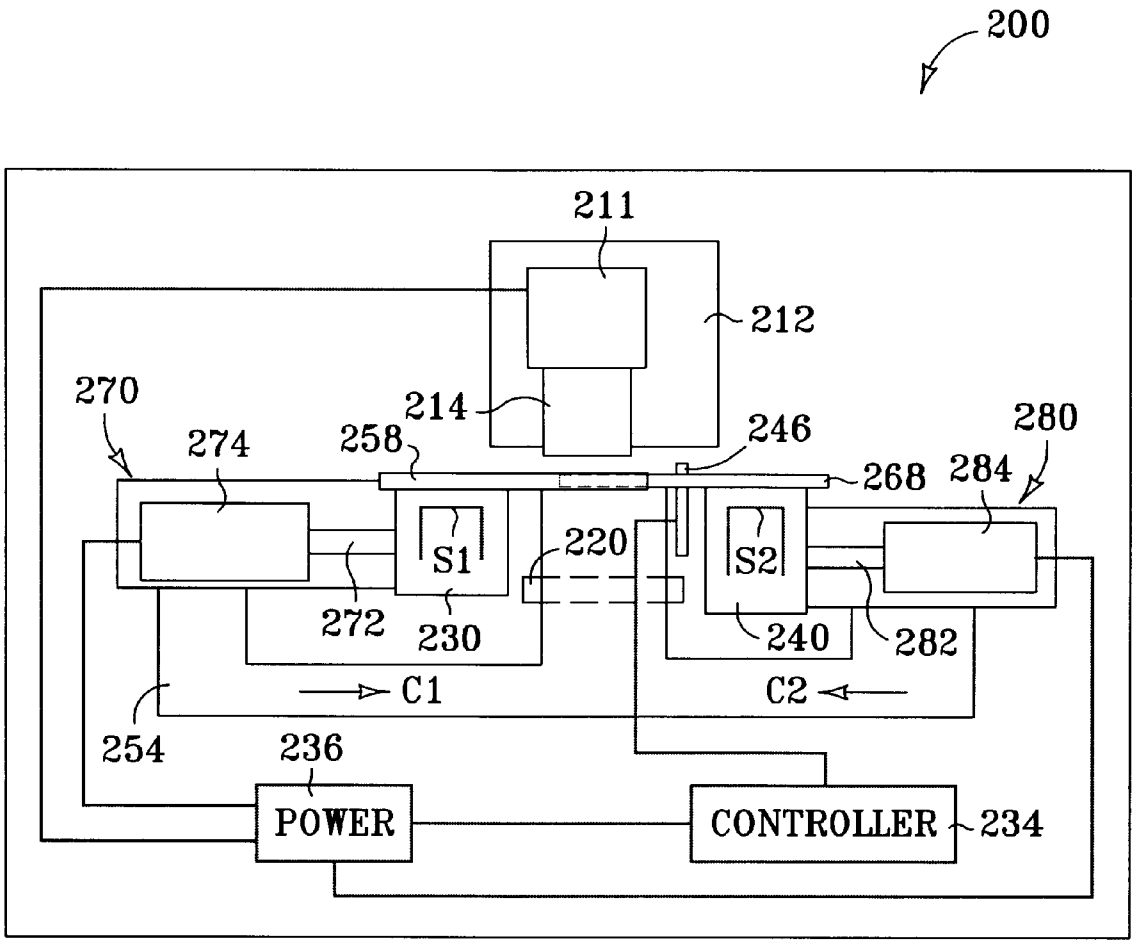
FIG. 6 depicts an end view of a stapler in accordance with a second embodiment of the present invention.

Turning to FIG. 6, an end view of a stapler 200 in accordance with a second embodiment of the present invention is depicted. The stapler 200 can be substituted for the stapler 100 of FIGS. 1 and 2 in the imaging apparatus 10, or the stapler 200 can be operated as a stand-alone unit. The stapler 200 comprises a first cartridge 230 configured to receive a first staple S1 defined by a first leg length, and a second cartridge 240 configured to receive a second staple S2 defined by a second leg length. The first cartridge 230 is slidably supported by a first track 258, and the second cartridge 240 is slidably supported by a second track 268. Although not evident in the view depicted in FIG. 6, first track 258 is positioned in front of second track 268 so that the two tracks both have portions which pass under the stapling head 212. The stapler 200 also includes a stapling head 212 having a stapling head actuator 211 (such as a solenoid) configured to drive the staples into a sheet stack (not shown) using the striking plate 214. The sheet stack is positioned between the striking member 214 and an anvil 220 for stapling of the sheets.

Before the stapling process occurs, one of the cartridges 230 or 240 is moved into position under the striking plate 214 so that respective staple type or size S1 or S2 can be used to staple the sheet stack. Accordingly, the stapler 200 has a first cartridge positioning actuator 270 configured to position the first cartridge 230 under the stapling head 212. The first actuator 270 is shown as including a solenoid 274 and an extensible arm 272 which can translationally move the first cartridge 230 in direction "C1" into position under the stapling head 212 in the manner described above with respect to solenoid 174 of FIG. 4. The second actuator 280 is shown as including a solenoid 284 and an extensible arm 282 which can translationally move the second cartridge 240 in direction "C2" into position under the stapling head 212. The cartridge positioning actuators 270 and 280, the cartridge support tracks 258 and 268, and the anvil 220 can all be supported by frame member 254. By selective actuation of the actuators 270 and 280, the respective cartridges 230 and 240 can be alternatingly positioned (i.e., selectively positioned) in line with the stapling head 212.

The stapler 200 can further include a sheet stack thickness sensor 246 which can be used to detect the thickness of the sheet stack, similar to the sensor 46 described above with respect to FIG. 2. The stapler 200 can be provided with a controller 234 and a power supply 236. The power supply 236 can be used to actuate the cartridge positioning actuators 270 and 280, as well as the stapling head actuator 211. The controller 234 can be configured to operate in a manner similar to that described above with respect to controller 34 of FIGS. 1 and 2 and/or controller 106 of FIG. 3. That is, the controller 234, upon receiving a signal to staple the sheet stack, can receive a sheet stack thickness signal from the sensor 246. Based upon the detected thickness of the sheet stack, the controller 234 determines which of the staples, S1 or S2, is most appropriate for the current stapling job. The controller 234 then directs the power supply 236 to actuate one of the cartridge positioning actuators (270 or 280, depending upon which actuator is associated with the cartridge (230 or 240) containing the selected staple) to move the proper cartridge under the stapling head 212. The controller 234 then directs the power supply 236 to actuate the stapling head actuator 211 and thereby drive the selected staple into the sheet stack.

Figure 5:
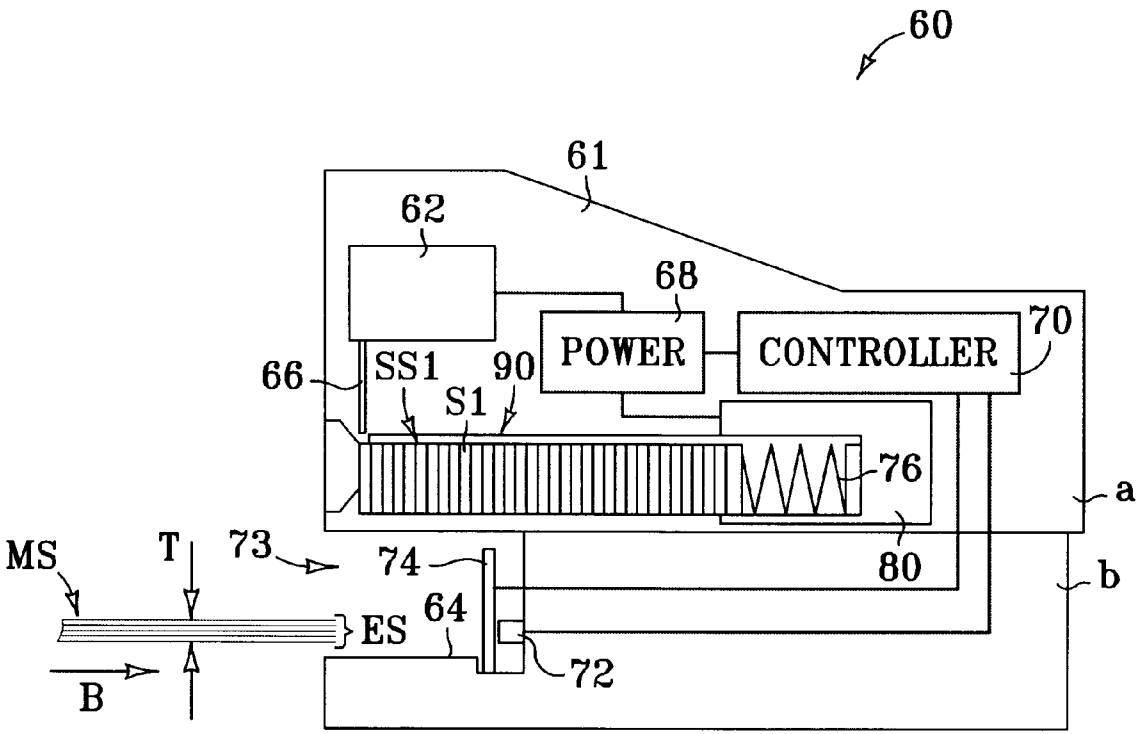
FIG. 5 is a side elevation view depicting a stand-alone stapler in accordance with the present invention.

Turning to FIG. 5, a stand-alone stapler 60 is depicted in side view. FIG. 5 shows how a stapler in accordance with the present invention can be embodied as a stand-alone stapler, rather than being a unit within another device, as is depicted in FIG. 1 wherein the stapler 100 is installed within an imaging apparatus 10. All of the components of the stapler 60 of FIG. 5 are contained within a two-part housing 61 having an upper part "a" which is downward acting towards the lower part "b" to bring staples contained within the upper part "a" in proximity to the sheet stack "MS" for stapling. The stapler 60 is configured to staple a sheet stack "MS" comprised of a plurality of sheets of media (such as paper) together. The stapler 60 is further configured to select one of a plurality of staples of different sizes to staple the sheet stack. The criteria for selecting the staple is preferably based upon the thickness "T" of the sheet stack MS, although the criteria can also be the media type. For example, it may be preferable to use a first type of staple for paper media, and a second type of staple for transparencies. The media type can either be selected by a user, or, when appropriate sensors are provided, the media type can be determined automatically. The stapler 60 further includes a stapling head 62 having a striking plate 66 for driving a staple into the sheet stack MS. Preferably, the stapling head 62 is power driven by power supply 68, although this is not a requirement, and the stapling head can be manually actuated by a user. An anvil 64 is provided to crimp the free ends of the staple legs against the bottom sheet of the sheet stack MS as a staple is driven through the sheet stack.

The stapler 60 is also configured to contain a plurality of staple cartridges. As depicted, only a single staple cartridge 90 is shown, containing a staple strip SS1 comprised of a plurality of staples S1. A feed spring 76 urges the staple strip SS1 towards the striking plate 66 so that the striking plate detaches the first staple from the staple strip SS1 when the stapling head 62 is actuated. Other staple cartridges can be provided in alignment with cartridge 90, and are not visible in this view since they are blocked by the cartridge 90. However, a brief review of FIG. 3, which is a plan view of the stapler 100, shows how multiple staple cartridges (130 and 140) can be aligned. Returning to FIG. 5, the stapler 60 also includes a staple cartridge position actuator 80, which can operate in the manner described above for positioning actuators 154, 164 (FIG. 3) and 454 (FIG. 8) to position any one of the staple cartridges in alignment with the stapling head strike plate 66.

As depicted, the stapler 60 preferably comprises a controller to allow automatic operation of the stapler 60 in the manner described above with respect to the controller 106 of FIG. 3. However, a controller 70, and positioning actuator 80, are not necessary for the operation of the stapling apparatus 60, and the staple cartridges can be positioned manually under the stapling head. The stapler 60 can also include activation switch 72, which is located in a different plane than the sensor 74. Thus, when the sheet stack MS is inserted in direction "B" into the throat 73 of the stapler 60, the edge of the stack "ES" contacts the activation switch 72. The activation switch 72 then sends an activation signal to the controller 70. The controller. 70 then polls the sensor 74 to determine the thickness "T" of the sheet stack MS. The controller 70 then determines which of the available staple cartridges contains staples having leg lengths most appropriate for stapling a sheet stack of thickness "T". If the selected staple cartridge is not currently positioned under the stapling head 62, the controller 70 directs the power supply 68 to actuate the cartridge positioning actuator 80 to move the selected staple cartridge in alignment with the stapling head 62. The actuator 80 can also be used to move a non-selected staple cartridge away from the stapling head 62 prior to moving the selected cartridge under the stapling head. Once the cartridge with the selected staples has been positioned under the stapling head, the controller 70 can direct the power supply 68 to actuate the stapling head 62 and thus drive the staple into the sheet stack MS.

It will be appreciated that the stapling components inside of the stapler housing 61 of the stapler 60 can be replaced with the components of stapler 100 of FIG. 3, stapler 200 of FIG. 6, or stapler 400 of FIG. 8. Further, the controller 70 of stapler 60 can be in signal communication with a user interface such that a user can identify to the controller 70 which staple the user desires to have the stapler use. The user interface can thus be used in lieu of, or to override, the thickness sensor 74.

Figure 7:
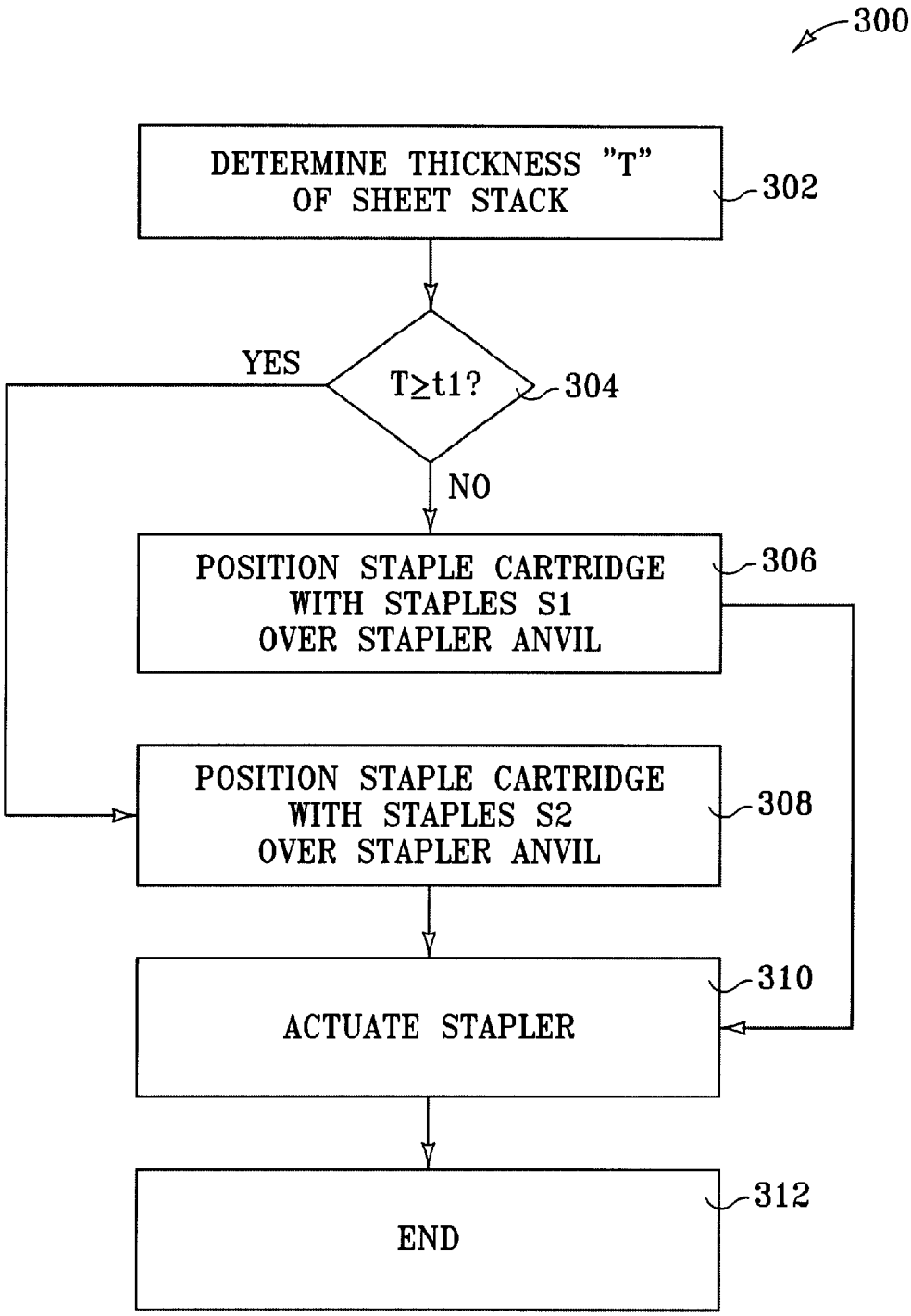
FIG. 7 depicts a flow chart of a control scheme which can be used to control a stapler in accordance with the present invention.

The controllers variously described in the previous discussion can be an electronic device having a processor or state circuits for performing the various tasks described above. FIG. 7 depicts a flowchart 300 comprising a series of steps that the controller can be configured to perform. For the sake of the following discussion, the flow chart will be described with exemplary reference to the stapler 100 of FIGS. 1, 2 and 3, in which case the steps of the flow chart are executed by controller 34 in the imaging apparatus 10 of FIGS. 1 and 2 (which can also be controller 106 of FIG. 3). However, it is understood that the flow chart 300 can be used with any of the stapling apparatus previously described.

Beginning at step 302 of the flow chart 300, the controller determines the thickness "T" of the sheet stack (FP of FIG. 1). This step can be accomplished using a sensor such as thickness sensor 46 of FIG. 2. Another manner in which the controller can determine the thickness is by counting the number of sheets of media which are processed in a print or copy job using the sheet counting device 35 of FIG. 1. The controller can be provided with a look-up table of average sheet thickness, and the controller can then multiply the average sheet thickness by the number of sheets to arrive at an estimate of the thickness of the sheet stack. When more than one copy is being printed or reproduced, then the controller can receive information from the user input station 22 (or from a connected computer) regarding the number of copies to be made, and the number of originals in the copy job (or pages in a print job). Typically, the number of sheets in each sheet stack in a multi-copy copying or printing job will be the same, and so the processor only needs to know the number of original sheets being copied, or the number of pages in a document being printed. When the only information the controller can obtain from the user input station 22 regards the number of duplicate copies to be made, then the controller can obtain the total sheet count from the sheet counting device 35. The controller can then be configured to divide the total sheet count by the number of duplicate copies to arrive at the number of sheets in each duplicate copy. Alternately, when the imaging apparatus is provided with a sheet feeder for feeding sheets of an original document to be copied, the controller can obtain the sheet count for each sheet stack by counting the number of originals which pass through the sheet feeder, which can be done either as the originals are fed through the feeder for scanning or in a pre-scanning count feed. Once the number of sheets in the sheet stacks has been determined by any of the above described techniques, then the controller can use sheet thickness information from a look-up table to calculate an estimated thickness for the sheet stack (which will typically be the same for all duplicate copies).

After the controller determines the measured or estimated thickness of the sheet stack, the controller checks at step 304 to determine whether the thickness "T" is greater than a minimum thickness "t1". If not, then at step 306 the controller determines that the shorter staples "S1" contained in a first cartridge (e.g., cartridge 130 of FIG. 4) should be used, and positions the first cartridge over the anvil (120). This can be performed using the cartridge positioning actuator 154 in the manner described above with respect to FIGS. 3 and 4. However, if at step 302 the controller determines that the sheet stack thickness "T" is greater than the minimum thickness "t1", then at step 308 the controller determines that the longer staples "S2" contained in a second cartridge (e.g., cartridge 140 of FIG. 4) should be used, and positions the second cartridge over the anvil (120). This can be performed using the cartridge positioning actuator 164 in the manner described above with respect to FIGS. 3 and 4. The controller can be configured to determine which cartridge contains the correct staple to use by configuring the staple cartridges to accept a certain size staple. For example, cartridge 130 can be configured to receive staples having a leg length of ⅜ inch, and cartridge 140 can be configured to receive staples having a leg length of ⅝ inch. Alternately, a user can program the controller with staple leg length information. In another variation, each cartridge can be provided with a staple leg length sensor which can measure the leg length of the staples loaded into the cartridge, and the leg length sensors can then provide leg length information to the controller.

Once the cartridge containing the selected staples has been positioned over the anvil 120 at either step 306 or 308, then at step 310 the controller actuates the stapling head actuator in the stapling head (either 112 or 162) associated with the cartridge (either 130 or 140) positioned over the anvil 120. This causes the selected staple to be driven through the sheet stack, thus securing the sheets in the stack to one another. When the stapling apparatus 100 is configured in a sorter, such as sorter 40 of FIG. 1, then the controller can receive information from the user input station 22 regarding the number of duplicate copies to be made. If more than one duplicate copy is made of a given document and the other duplicated copies are sorted into the additional output trays 42, then the controller can cause the stapler 100 to be subsequently positioned proximate to each of the duplicate copies, and each duplicate copy can be stapled in turn. When more than one duplicate copy is made of a document, then the controller does not need to perform the steps of determining the sheet stack thickness and selecting an appropriate staple for each duplicate copy, since typically each duplicate copy will be of essentially the same thickness. After all of the sheet stacks have been stapled, then the stapling routine executed by the controller terminates at step 312.

It will be appreciated that the flow chart 300 of FIG. 7 is exemplary only, and that other process steps can be used to implement a stapling method in accordance with the present invention, and to operate the stapling apparatus of the present invention. For example, rather than making the stapling process fully automatic, a user can direct the stapler to staple a sheet stack, and can select the staple to be used, using the user input station 22 of FIG. 1. Also, as described previously, the staple cartridge having the selected staples contained therein can be manually positioned over the predetermined stapling position on the sheet stack, and then the staple can be driven into the sheet stack either manually or using a powered stapling head. Further, while the specific example shown and described above is for a stapler having two different staple sizes or types from which to choose, it can be seen that the method can be extended to three of more different staple types or sizes. For example, if three different staple sizes are provided, then after receiving a "yes" response to checking the sheet stack thickness for "T>t1?" at step 304, the processor can then check to determine whether the sheet stack thickness is greater than a second thickness "t2". If so, a longer staple can be used; if not, an intermediate length staple can be used.

As suggested by the previous discussion, the invention further includes a method of stapling together a first stack of sheets of media, such as the sheet stack "FP" of FIG. 1. The method includes the steps of providing a first strip of staples (such as staples S1 of FIG. 4) having legs defined by a first length (e.g., L1), and providing a second strip of staples (e.g., S2) having legs defined by a second length (e.g., L2). One of the first or the second strips of staples is then moved over a predetermined position on the first stack of sheets (e.g., position "S" in FIG. 3). This moving or positioning of the staple strips can be accomplished using any of the staple cartridge positioning actuators variously described above. The method then includes the step of detaching a staple from the strip of staples moved over the predetermined position on the first stack of sheets, and driving the staple through the first stack of sheets. This last step can be performed for example by using the stapling head 112 or 162 depicted in FIG. 3. Since the stack of sheets can be defined by a thickness, the method can further include the step of measuring the thickness of the stack of sheets, and selecting the strip of staples to be moved over the predetermined position on the first stack of sheets based on the measured thickness. This can be accomplished, for example, by using the sensor 46 described above with respect to FIG. 2 in conjunction with the controller 34 (or controller 106 of FIG. 3). Alternately, rather than measure the sheet stack thickness, the method can include the step of estimating the thickness of the first stack of sheets, and selecting the strip of staples to be moved over the predetermined position on the first stack of sheets based on the estimated thickness. This can be performed as described above with respect to the flow chart 300 of FIG. 7 by using information obtained from a sheet counting device (such as device 35 of FIG. 1), which can be supplemented with information from the user input station 22. All of this information can be processed by the controller (34 of FIGS. 1 and 2, or 106 of FIG. 3), along with average sheet thickness information, to arrive at an estimated sheet stack thickness.

As described above, when the stapling apparatus is used in a device having the capability to receive multiple duplicate copies of a document (e.g., when the stapler is configured within a sorter such as sorter 40 of FIG. 1), then the method can include the step of moving the strips of staples to a location near a second stack of sheets. After the strips of staples have been thusly relocated, a staple from the strip of staples moved over the predetermined position on the second stack of sheets is detached from the strip of staples, and is driven through the second stack of sheets.

It will be appreciated that when I describe "moving the strip of staples over the stack of sheets" I am referring to relative movement. Thus, rather than physically moving the strips of staples, the stack of sheets themselves can be moved such that the predetermined position on the stack of sheets is now positioned over the selected strip of staples, and a staple from the strip can then be driven through the stack of sheets.

While the above invention has been described in language more or less specific as to structural and methodical features, it is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A stapling apparatus for driving a staple into a sheet stack defined by a plurality of sheets, the stapling apparatus comprising:

a first stapler comprising a first cartridge configured to receive a first staple defined by a first leg length, and a first stapling head configured to drive the first staples into the sheet stack;

a second stapler comprising a second cartridge configured to receive a second staple defined by a second leg length, and a second stapling head configured to drive the second staples into the sheet stack;

a stapler positioning actuator configured to selectively position one of the first or the second stapling heads over a predetermined position on the sheet stack; and a fixed anvil positioned proximate the predetermined position and positioned such that the sheet stack, when being stapled, is positioned between the anvil and the stapling head which is positioned over the predetermined position.

2. The stapling apparatus of claim 1, and wherein the stapler positioning apparatus comprises one of: a solenoid in mechanical communication with the first and second stapler; or a linear motor having a body and a slide portion configured to slidably move with respect to the body, and wherein the first and second stapler are supported by the slide portion.

3. The stapling apparatus of claim 1, and further comprising a controller configured to actuate the stapler positioning actuator in response to receiving a stapler selection signal.

4. The stapling apparatus of claim 3, and wherein the sheet stack is defined by a thickness, the stapling apparatus further comprising a sensor configured to detect the thickness of the sheet stack and to generate a thickness signal in response thereto, and wherein the controller uses the thickness signal as the selection signal.

* * * * *

UNITED STATES PATENT AND TRADEMARK OFFICE

CERTIFICATE OF CORRECTION

PATENT NO. : 6,595,509 B2
DATED : July 22, 2003
INVENTOR(S) : Robert Sesek

It is certified that error appears in the above-identified patent and that said Letters Patent is hereby corrected as shown below:

Column 4,
Line 19, delete “stapled” and insert therefor -- staple --
Line 23, delete “comprises” and insert therefor -- comprise --

Column 5,
Line 12, delete “can,be” and insert therefor -- can be --

Column 6,
Line 5, delete “stapled” and insert therefor -- staple --
Line 32, after “house” delete “a”

Column 8,
Line 5, delete “the,staple” and insert therefor -- the staple --
Line 10, delete “predetermine” and insert therefor -- predetermined --

Column 11,
Line 33, delete “controller.70” and insert therefor -- controller 70 --

Column 13,
Line 44, delete “of” and insert therefor -- or --

Column 14,
Line 4, “Since” should begin a new paragraph

Signed and Sealed this

Fourth Day of January, 2005

JON W. DUDAS
*Director of the United States Patent and Trademark Office*